US010683180B2

(12) United States Patent
Serra Obiols et al.

(10) Patent No.: US 10,683,180 B2
(45) Date of Patent: Jun. 16, 2020

(54) FEED ASSEMBLY FOR SUPPLYING SHEET ELEMENTS TO A GRAPHIC PRINTING STATION

(71) Applicant: COMERCIAL Industrial Maquinaria Carton Ondulado, S.L., Barcelona (ES)

(72) Inventors: Ramon Serra Obiols, Barcelona (ES); Jordi Puig Vargas, Barcelona (ES)

(73) Assignee: COMERCIAL INDUSTRIAL MAQUINARIA CARTON ONDULADO, S.L., Barcelona (ES)

( * ) Notice: Subject to any disclaimer, the term of this patent is extended or adjusted under 35 U.S.C. 154(b) by 0 days.

(21) Appl. No.: 16/302,629

(22) PCT Filed: May 17, 2017

(86) PCT No.: PCT/ES2017/070322
§ 371 (c)(1),
(2) Date: Nov. 17, 2018

(87) PCT Pub. No.: WO2017/198885
PCT Pub. Date: Nov. 23, 2017

(65) Prior Publication Data

US 2019/0291985 A1 Sep. 26, 2019

(30) Foreign Application Priority Data

May 18, 2016 (ES) ..... 201630647

(51) Int. Cl.
*B65H 3/08* (2006.01)
*B65H 3/12* (2006.01)
(Continued)

(52) U.S. Cl.
CPC ..... *B65H 3/126* (2013.01); *B65H 3/085* (2013.01); *B65H 3/34* (2013.01); *B65H 5/224* (2013.01);
(Continued)

(58) Field of Classification Search
CPC ..... B65H 3/126; B65H 3/085; B65H 5/224; B65H 11/005; B65H 2403/514; B65H 2406/3222
See application file for complete search history.

(56) References Cited

U.S. PATENT DOCUMENTS 4,336,929 A * 6/1982 Hanzlik ..... B65H 3/126 271/106
5,074,539 A * 12/1991 Wells ..... B65H 3/042 271/12
(Continued)

FOREIGN PATENT DOCUMENTS

EP 2982627 A1 2/2016
ES 2547473 B1 10/2015

OTHER PUBLICATIONS

WIPO, International Search Report, dated Jul. 11, 2017, in International Application No. PCT/ES2017/070322, filed May 17, 2017.
(Continued)

*Primary Examiner* — Patrick Cicchino
(74) *Attorney, Agent, or Firm* — Thedford I. Hitaffer; Hitaffer & Hitaffer, PLLC

(57) ABSTRACT

An insertion assembly for the continuous and automated feeding of laminar elements into a graphic printing station without the involvement of roller elements in the process, allowing the distance between the laminar elements in question to be adjusted such that adjacent laminar elements may be positioned very close to each other regardless of their length. Said assembly comprises an insertion device (1) that includes a rotating belt system on which the laminar
(Continued)

elements (3) can be moved horizontally, and suction means, with the insertion device (1) connected to a stacking area (4) and; a pulling device (2) that includes a rotating belt system on which the laminar elements from the insertion device (1) can be moved, and suction means, with the pulling device (2) connected to a graphic printing station, said pulling device adjoining the insertion device (1) in a direction of forward motion.

11 Claims, 10 Drawing Sheets

(51) Int. Cl.
*B65H 3/34* (2006.01)
*B65H 5/22* (2006.01)
*B65H 5/36* (2006.01)

(52) U.S. Cl.
CPC ..... *B65H 5/36* (2013.01); *B65H 2403/514* (2013.01); *B65H 2404/61* (2013.01); *B65H 2404/64* (2013.01); *B65H 2406/3222* (2013.01); *B65H 2701/176* (2013.01)

(56) References Cited

U.S. PATENT DOCUMENTS 5,464,202 A * 11/1995 Capdeboscq ..... B65H 3/126 271/11
6,412,770 B1 7/2002 Demmeler
7,293,770 B2 * 11/2007 Edinger ..... B65H 11/005 198/689.1
7,635,124 B2 * 12/2009 Sardella ..... B65H 3/042 271/10.06
7,980,558 B2 * 7/2011 Moore ..... B41J 11/007 271/276

OTHER PUBLICATIONS

WIPO, Written Opinion, dated Jul. 11, 2017, in International Application No. PCT/ES2017/070322, filed May 17, 2017.
WIPO, Preliminary Report on Patentability, dated May 11, 2018, in International Application No. PCT/ES2017/070322, filed May 17, 2017.

* cited by examiner

FEED ASSEMBLY FOR SUPPLYING SHEET ELEMENTS TO A GRAPHIC PRINTING STATION

CROSS-REFERENCE TO RELATED APPLICATIONS

This application, filed under 35 USC 371, is a United States National Stage Application of International Application No. PCT/ES2017/070322, filed May 17, 2017, which claims priority to ES Application No. P201630647, filed May 18, 2016, the disclosures of which are incorporated herein by reference.

OBJECT OF THE INVENTION

The object of this application is the registration of a belt-based insertion assembly for the continuous feeding of laminar elements into a graphic printing station.

More specifically, the invention proposes the development of an insertion assembly for the continuous and automated feeding of laminar elements into a graphic printing station, without the involvement of roller elements in the process, with the possibility of adjusting the distance between the laminar elements, such that adjacent laminar elements may be positioned very closely, regardless of their length, with the laminar elements in a stacking area for laminar elements arranged in at least one column.

BACKGROUND OF THE INVENTION

The use of flexography to print sheets of cardboard intended, for example, to form boxes, is currently known. This technique consists of passing cardboard sheets or laminar elements on a horizontal plane between rollers installed in a digital printing station.

To do this, the use of an insertion device to feed laminar bodies (of different sizes) into a graphic printing station like the one described above is known, and is described in the Spanish patent n° ES 2 547 473 granted to this applicant.

Traditionally, pairs of cylinders have been used as the pulling elements after the insertion device to finish inserting the cardboard sheet into the line for printing, die-cutting, folding, etc. The pulling of the cardboard sheets such that they pass through a defined space between two cylinders results in the lamination of the sheets to a certain degree, which, in the specific case of corrugated cardboard sheets, may generate an undesired effect of loss of mechanical properties in regard to strength.

In addition, the applicant has no knowledge of any invention at the present time that is equipped with all of the features covered in this description.

DESCRIPTION OF THE INVENTION

The present invention has been developed for the purpose of providing an insertion assembly that represents a novelty within the field of application and resolves the drawbacks mentioned above, also providing other additional advantages that will be evident based on the description included below.

The object of the present invention is therefore to provide an insertion assembly to feed laminar elements into a graphic printing station, with the laminar elements located in a stacking area for the laminar elements arranged into at least one column, which is characterized in that it comprises:

an insertion device that includes a rotating belt system on which the laminar elements may be moved horizontally, and suction means, with the insertion device connected to the stacking area, and a pulling device that includes a rotating belt system on which the laminar elements from the insertion device and suction means may be moved horizontally, with the pulling device connected to a graphic printing station equipped with a rotating belt, with this pulling device adjoining the insertion device in the direction of forward movement.

In this way, a laminar element is carried from the stacking area to the graphic printing station through the insertion device and the pulling device, with the speed of the rotating belt of the pulling device remaining constant, and equal or essentially equal to the speed of movement of a series of movement means in the printing station, on which the laminar element will be moved during the operation thereof.

To do this, the development of an insertion assembly is proposed for the automated feeding of laminar elements, such as sheets of cardboard, into a graphic printing station without the involvement of roller elements in the process, and which also allows the adjustment of the distance between the laminar elements in question, such that adjacent laminar elements may be positioned very close to each other regardless of their length.

According to one embodiment, the insertion device includes a lifting means that raises the laminar element with respect to the rotating belt, with the movement of the lifting means synchronized with the suction means.

According to one embodiment, the insertion device includes a lifting means that raises and lowers the laminar element with respect to the rotating belt, depending on the operating stage, with the movement of the lifting means synchronized with the suction means.

Preferably, the aforementioned suction means include a series of valve means that are integrally joined to the lifting means, such that when the valve means are open, the lifting means is in a bottom position, whilst when the valve means are closed, the lifting means is in a top position.

According to another aspect of the invention, the suction means housed in the insertion device have two suction chambers, while the suction means housed in the pulling device have three adjoining suction chambers.

According to another characteristic of the invention, the belt system of the insertion device comprises a plurality of pulleys on which a belt slides, with one of the pulleys driven by conventional motor means.

Likewise, the belt system of the pulling device also comprises a plurality of pulleys on which a belt slides, with one of the pulleys driven by a series of conventional motors.

Beneficially, the lifting means is kinematically connected to an eccentric mechanism and a series of elastic means, with said eccentric mechanism acting on the valve means, which are integrally connected to the eccentric mechanism. This construction configuration provides a simple way to guarantee synchronized coordination between the suction means and the lifting element.

According to another aspect of the invention, the lifting means comprises a support plate that has a first horizontal section that is intended to support a laminar element, and a second section that extends downward, which is in contact with the elastic means and the eccentric mechanism.

Other characteristics and advantages of the insertion assembly that is the object of the present invention will be evident based on the description of a preferred, though non-exclusive, embodiment, which, by way of a non-limiting example, is illustrated in the accompanying drawings, wherein:

DESCRIPTION OF A PREFERRED EMBODIMENT

Figure 1:
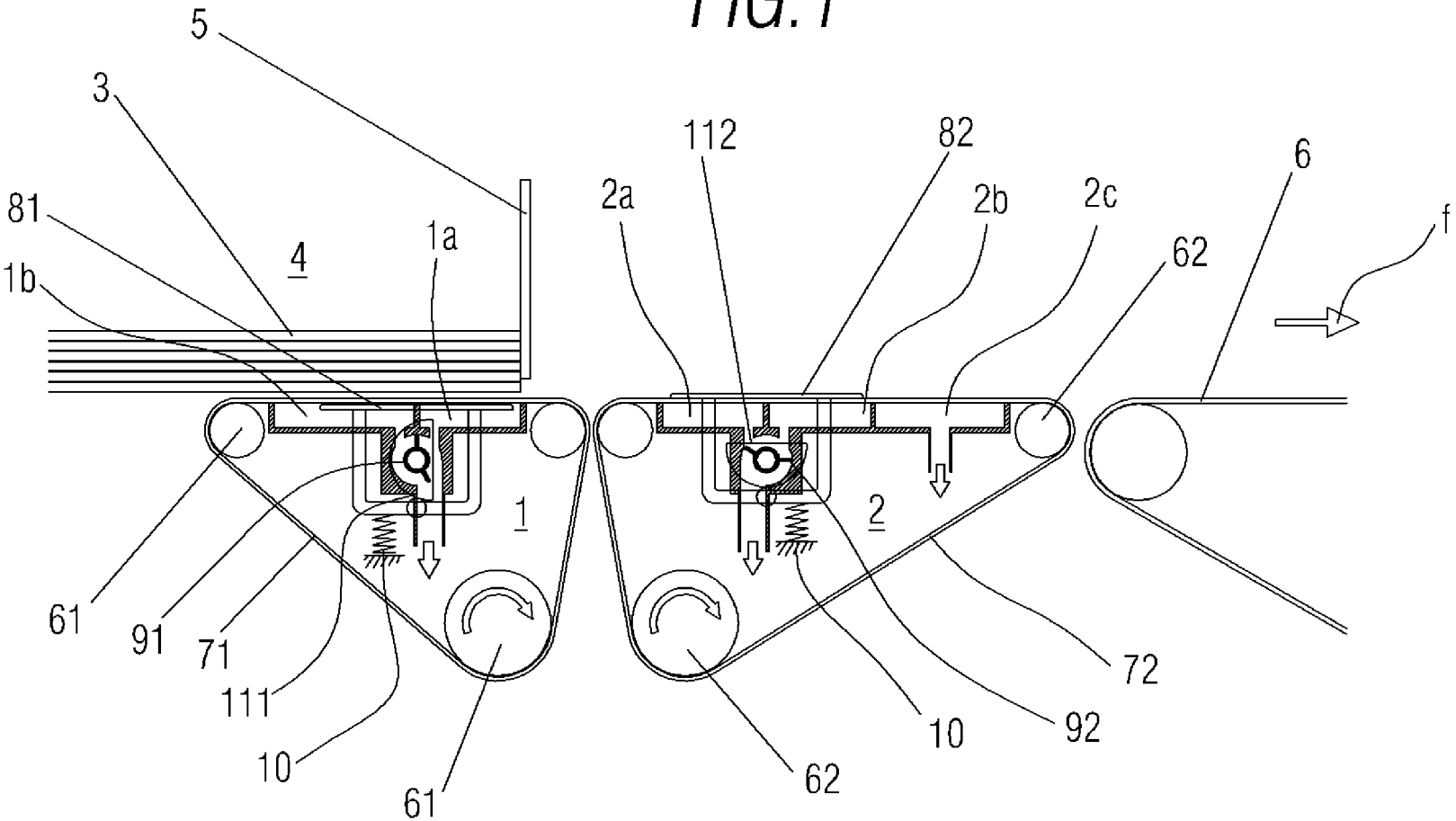
FIG. 1 provides a schematic elevation view of an insertion assembly according to the present invention.

In light of the aforementioned figures, and according to the adopted numbering, the figures show a preferred exemplary embodiment of the invention, which comprises the parts and elements that are indicated and described in detail below.

As the insertion assembly to feed laminar elements into a graphic printing station has been represented in the schematic drawings, with the laminar elements in a stacking area for laminar elements, for example made of cardboard (which will be used to form cardboard boxes), arranged in at least one column, mainly comprises an insertion device, generally indicated with the reference (1), and a pulling device, generally indicated with the reference (2).

More specifically, the insertion device (1) includes a rotating belt system on which the laminar elements (3) can be moved horizontally, and suction means, with the insertion device (1) connected to the stacking area (4) which includes a positioning wall, shown in the figures with reference (5).

Likewise, the pulling device (2) includes a rotating belt system on which the laminar elements (3) from the insertion device (1) can move horizontally, and suction means that will be explained below, with the pulling device (2) connected to a graphic printing station (not shown) equipped with a rotating belt (6), with said pulling device adjoining the insertion device in a direction of forward motion (indicated with the arrow fin FIG. 1). This description will not go into greater detail with regard to the printing station as it is not the object of the present invention and could be any suitable station known in the state of the art.

In this manner, a laminar element (3) is carried from the stacking area to the graphic printing station through the insertion device (1) and the pulling device (2), with the speed of the rotating belt (72) of the pulling device (2) constant and equal or essentially equal to the speed of movement of movement means in the printing station, on which the laminar element (3) moves during the operation thereof.

The aforementioned belt system of the insertion device (1) essentially comprises a series of pulleys (61) on which the belt (71) slides, with one of the pulleys driven by motor means (not shown), such as, for example, a step electric motor, etc. Moreover, the belt system of the pulling device essentially comprises a series of pulleys (62) on which a belt (72) slides, with the pulleys driven by motor means (not shown).

Both the insertion device (1) and pulling device (2) each include a lifting means (81) and (82), respectively, that lifts the laminar element (3) with respect to the rotating belt, with the movement of the lifting means (81, 82) synchronized with the suction means.

Now making reference to the suction means of both devices (1) and (2), these include valve means (91, 92), a butterfly valve in this embodiment, which are integrally joined to the respective lifting means (81), (82), such that when the butterfly valve is in an open condition, i.e. in a suction or intake condition, the corresponding lifting means (81, 82) is located in the lowest position.

In the case of the insertion device (1), the suction means include two suction chambers, while in the pulling device, the suction means have three adjoining suction chambers.

Each one of the lifting means (81, 82) is kinematically connected to an eccentric mechanism (111, 112) and includes elastic means, with said eccentric mechanism acting on the valve means, such that the valve means are integrally connected to the eccentric mechanism (91, 92). The lifting means can adopt two positions, with a top or raised position and a bottom or lowered position.

Figure 2:
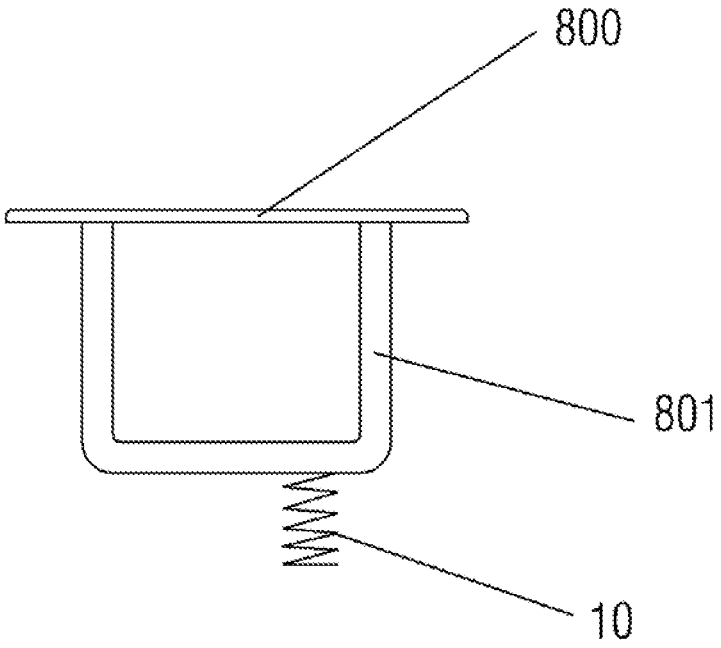
FIG. 2 is a detailed view of the lifting means.

As shown more clearly in FIG. 2, each one of the lifting means (81, 82) is comprised by a support plate that has a first horizontal section (800) intended to support a laminar element, and a second section (801) that extends downward and is intended to be in contact with the elastic means and the corresponding eccentric mechanism (111, 112).

The aforementioned elastic means arranged on the insertion device (1) and the pulling device (2) may be a spring (10) that is in contact at one end with the second section (801) of the lifting means (81, 82), such that the support plate is in contact at all times during the operation with the eccentric mechanism (111, 112).

The next section describes the operation of the insertion assembly described above, specifying in each one of the stages the positions that are adopted by the butterfly valve, support plate, and the belt speed. The expression "Vm" will be used to indicate that one of the belts, either of the insertion device or the pulling device, has the same speed as the belt in the graphic printing station.

Figure 3A:
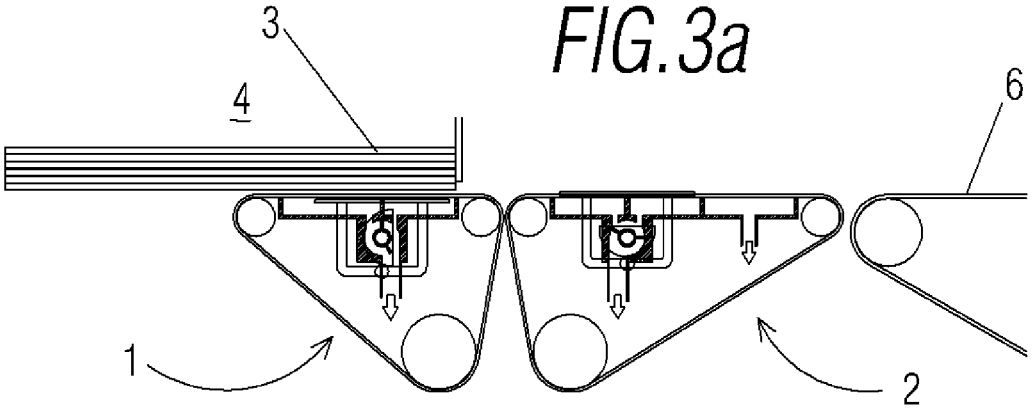
FIGS. 3*a*-3*h* are lateral elevation views of different operating phases of the assembly shown in FIG. 1 that is applicable to very long laminar elements.

Consequently, in the first stage (see FIG. 3*a*) when the laminar element (3) is fed onto the insertion device (1), the different components are in the following positions:

| Insertion device | | | Pulling device | | |
|---|---|---|---|---|---|
| valve | support plate | belt | valve | support plate | belt |
| closed | Bottom position | stopped | open | Top position | Vm |

Figure 3B:
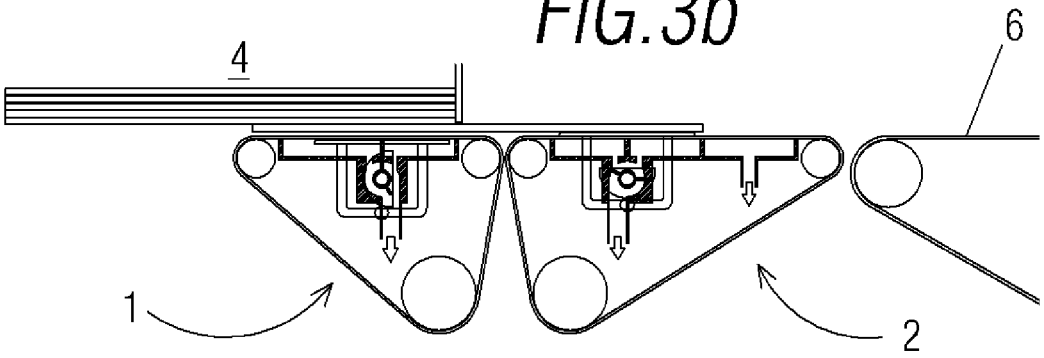

In stage two (see FIG. 3*b*), the laminar element accelerates on the belt of the insertion device:

| Insertion device | | | Pulling device | | |
|---|---|---|---|---|---|
| valve | support plate | belt | valve | support plate | belt |
| open | Bottom position | Accelerates to Vm | closed | Top position | Vm |

Figure 3C:
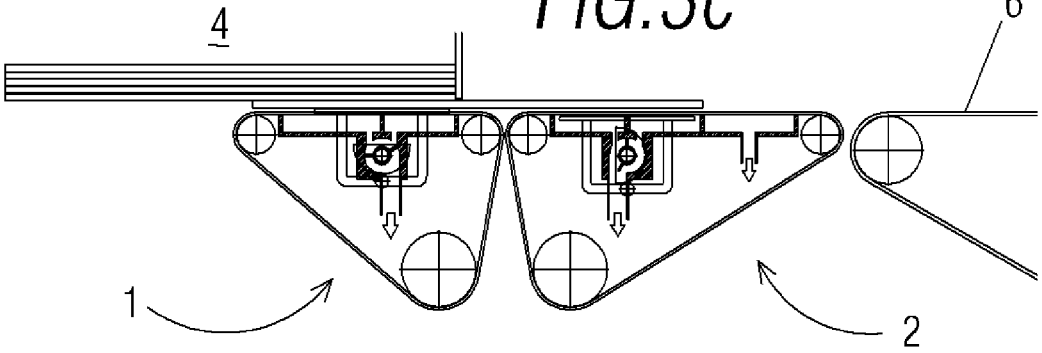

In stage three (see FIG. 3*c*), the laminar element is positioned such that it is pulled by the pulling device and slides over the support plate of the insertion device. In this stage, the laminar element is moved at the same speed as the belt of the printing station:

| Insertion device | | | Pulling device | | |
|---|---|---|---|---|---|
| Valve | support plate | Belt | valve | support plate | belt |
| Closed | Top position | stopped | open | Bottom position | Vm |

Figure 3D:
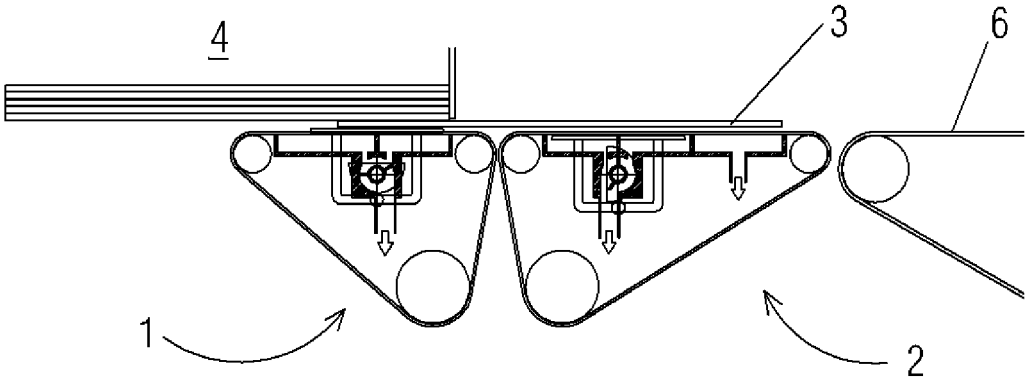

In stage four (see FIG. 3*d*), with the laminar element positioned in the insertion device and the pulling device such that it occupies the third suction chamber (2*c*) of the pulling device (2).

| Insertion device | | | Pulling device | | |
|---|---|---|---|---|---|
| Valve | support plate | Belt | valve | support plate | belt |
| closed | Top position | Stopped | open | Bottom position | Vm |

Figure 3E:
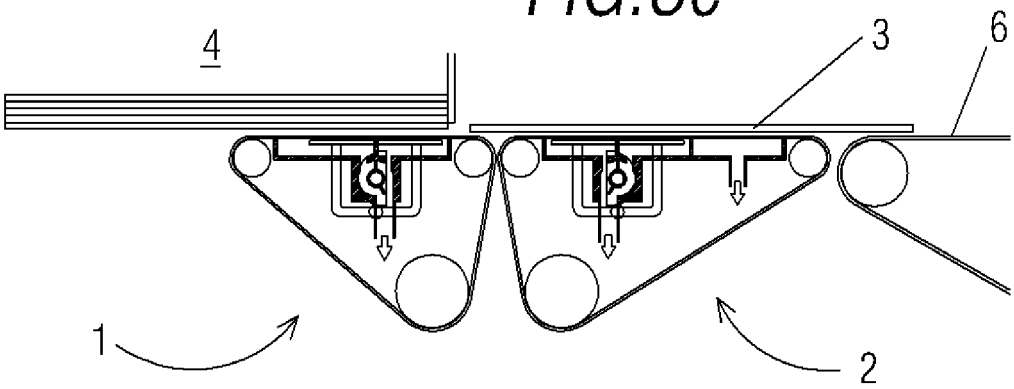

In stage five (see FIG. 3*e*), the back end of the laminar element passes through the positioning wall and the support plate of the insertion device lowers to absorb the next laminar element.

| Insertion device | | | Pulling device | | |
|---|---|---|---|---|---|
| Valve | support plate | Belt | valve | support plate | belt |
| open | Bottom position | Stopped | open | Bottom position | Vm |

Figure 3F:
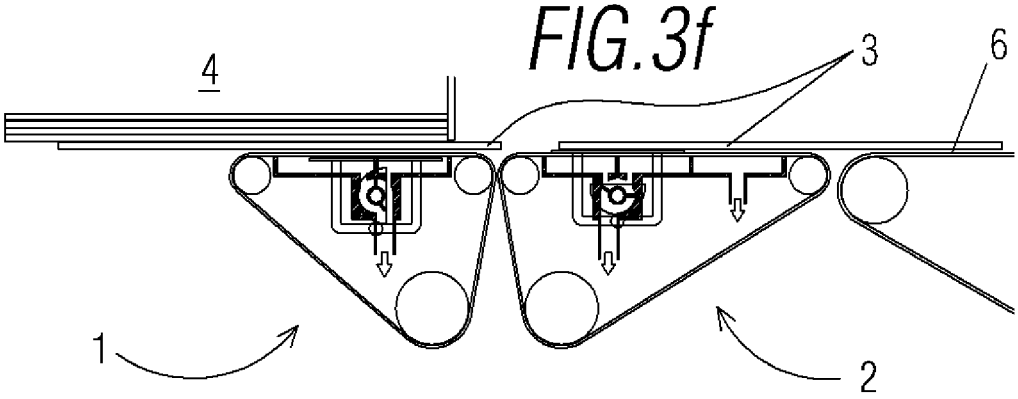

In stage six (see FIG. 3*f*), the support plate of the pulling device rises to receive the next laminar element and the cycle is repeated, such that the preceding laminar element (in the direction of forward motion) is pulled by the suction chamber.

| Insertion device | | | Pulling device | | |
|---|---|---|---|---|---|
| Valve | support plate | Belt | valve | support plate | belt |
| open | Bottom position | accelerating | closed | Top position | Vm |

Figure 3G:
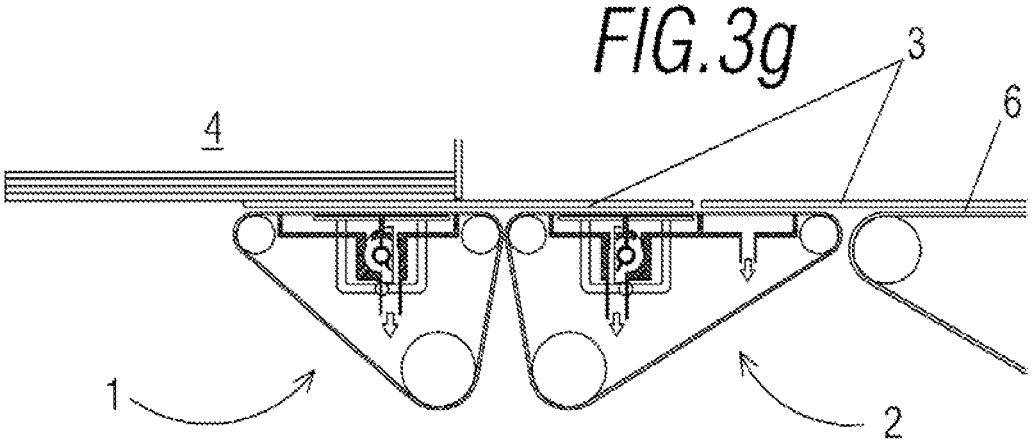

In stage seven (see FIG. 3*g*), the front end of the second laminar element is accelerating to move it very close to the laminar element that was transported previously.

Figure 5:
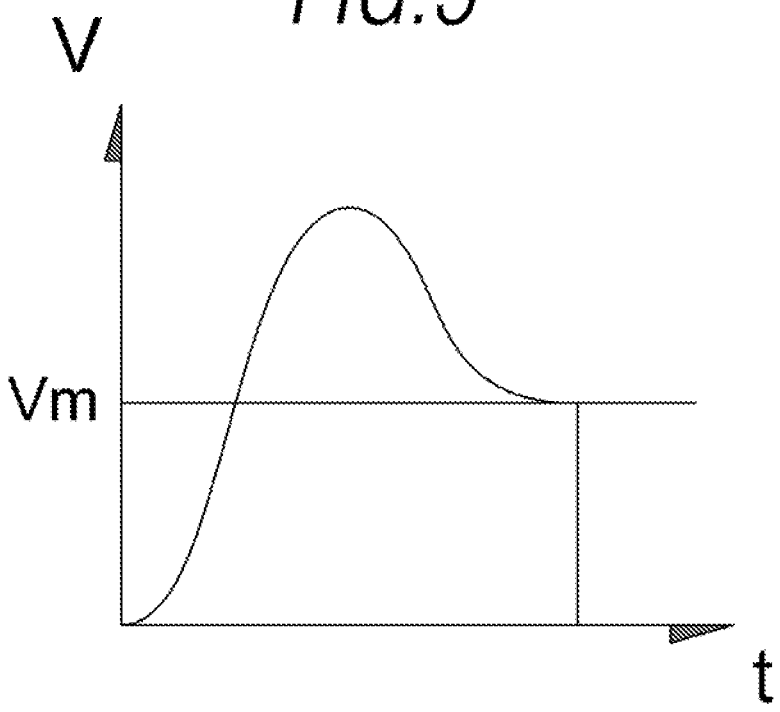
FIG. 5 is a graph that shows the relation between speed and time of the laminar element in phases five and seven.

Note that during stages six and seven, the laminar element that is inserted follows a specific acceleration condition (see the graph in FIG. 5) to reduce the distance between the laminar elements on the rotating belt (6).

| Insertion device | | | Pulling device | | |
|---|---|---|---|---|---|
| Valve | support plate | Belt | valve | support plate | belt |
| open | Bottom position | Vm | open | Bottom position | Vm |

Figure 3H:
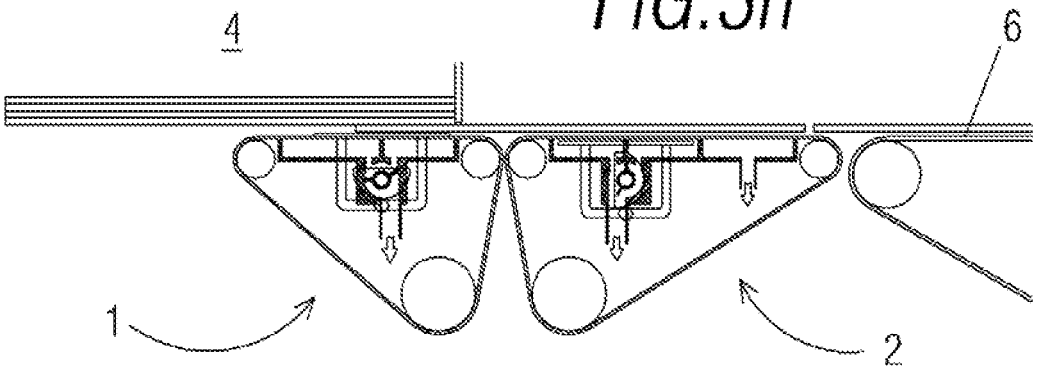
Figure 4A:
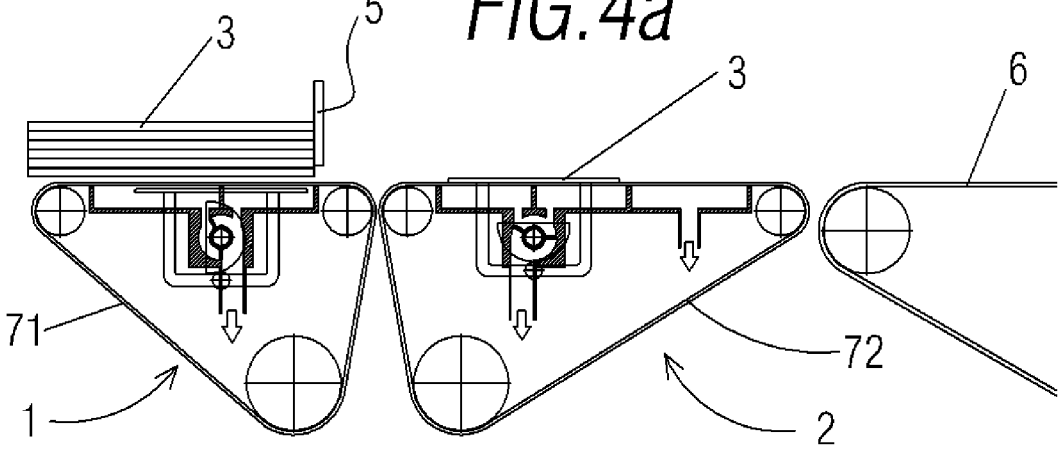
FIGS. 4*a*-4*h* are lateral elevation views of different operating phases of the assembly shown in FIG. 1 when the dimensions of the laminar element are smaller.
Figure 4B:
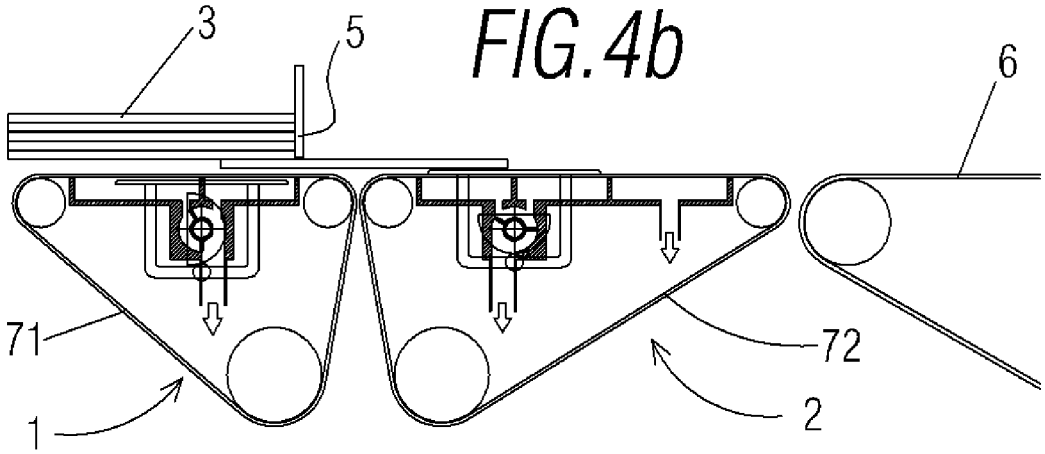
Figure 4C:
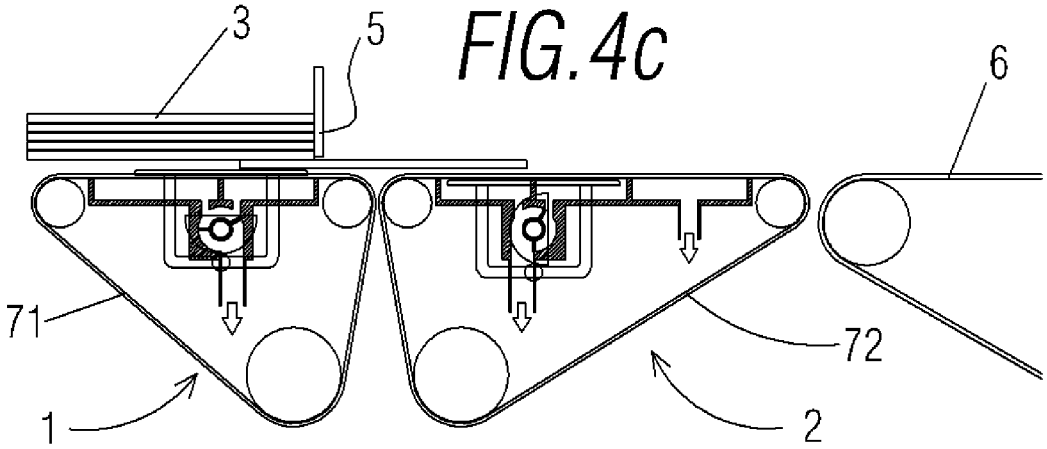
Figure 4D:
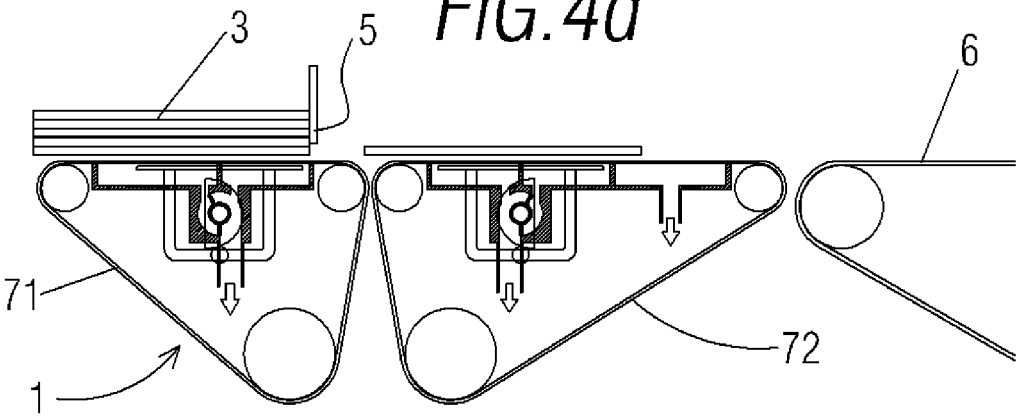
Figure 4E:
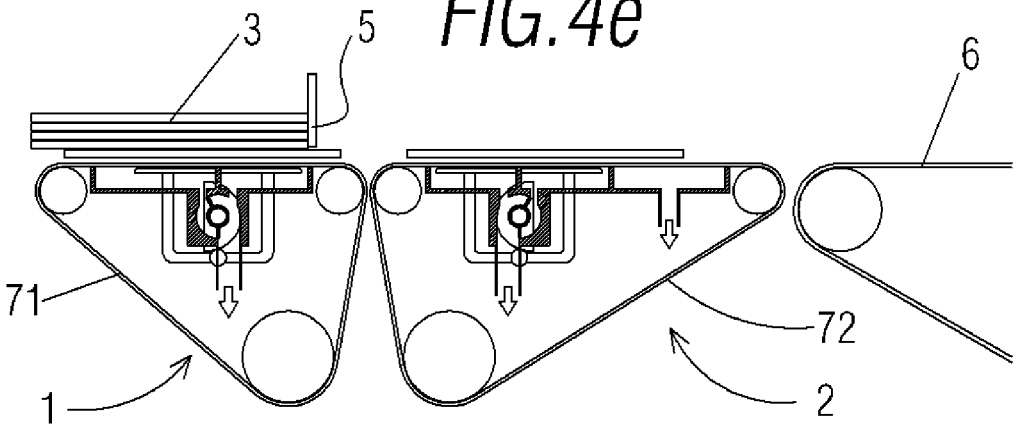
Figure 4F:
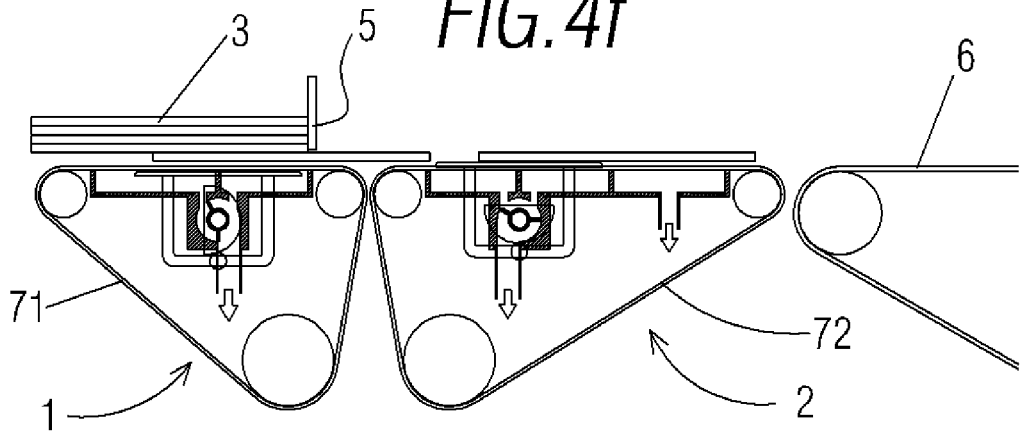
Figure 4G:
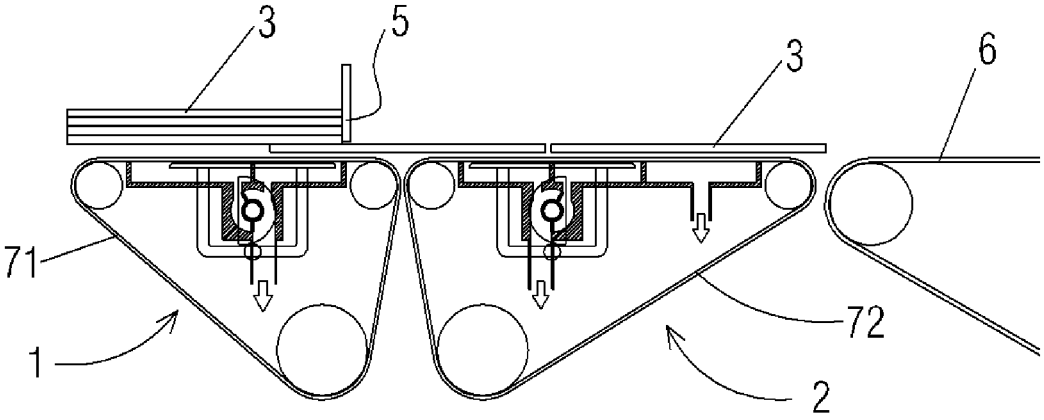
Figure 4H:
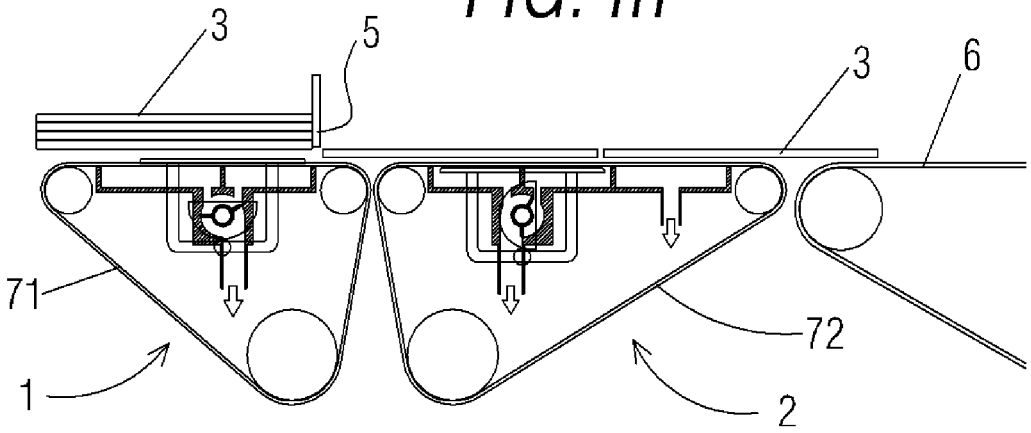

In stage eight (see FIG. 3*h*), the laminar element is pulled by the pulling device and slides over the support plate of the insertion device, on which the laminar element has the same speed as the speed of the belt in the printing station.

| Insertion device | | | Pulling device | | |
|---|---|---|---|---|---|
| Valve | support plate | Belt | valve | support plate | belt |
| closed | Top position | stopped | open | Bottom position | Vm |

The following section describes the operation of the invention as a whole as shown in FIG. 4, in which the laminar elements (3) are shorter than the example described above. In this type of operation, it should be noted that the butterfly valve turns a quarter turn in the opposite direction than when the longer element is inserted. In this way, the insertion device (1), instead of suctioning through the chambers (1*a*, 1*b*) only suctions through the chamber (1*a*), while the pulling device (2), instead of suctioning through (2*a*, 2*b*) only suctions through (2*a*), with the chamber (2*c*) always in a suction position when the insertion assembly is operating.

In stage one of operation (see FIG. 4*a*), the laminar element (3) located at the bottom of the column of laminar elements located in the stacking area (4) is positioned on the belt (71).

| Insertion device | | | Pulling device | | |
|---|---|---|---|---|---|
| Valve | support plate | Belt | valve | support plate | belt |
| open | Bottom position | stopped | closed | Top position | Vm |

In stage two (see FIG. 4*b*), the laminar element (3) accelerates on the belt of the insertion device:

| Insertion device | | | Pulling device | | |
|---|---|---|---|---|---|
| Valve | support plate | Belt | valve | support plate | belt |
| open | Bottom position | Accelerates to Vm | closed | Top position | Vm |

In stage three of the operation (see FIG. 4*c*), the laminar element (3) comes into contact with the belt of the pulling device (2) while at the same time sliding on the support plate of the insertion device (1). The laminar element (3) in this stage is pulled by the section of the belt of the pulling device located above the suction chamber (2*a*) and has the same speed as the belt in the graphic printing station.

| Insertion device | | | Pulling device | | |
|---|---|---|---|---|---|
| Valve | support plate | Belt | valve | support plate | belt |
| closed | Top position | stopped | open | Bottom position | Vm |

In stage four of the operation (see FIG. 4*d*), the laminar element (3) continues to be pulled by the belt section in the pulling device (2) located above the suction chamber (2*a*).

| Insertion device | | | Pulling device | | |
|---|---|---|---|---|---|
| Valve | support plate | Belt | valve | support plate | belt |
| open | Bottom position | stopped | open | Bottom position | Vm |

In stage five of operation (see FIG. 4*e*), the process of moving the next laminar element from the column in the stacking area (4) begins.

| Insertion device | | | Pulling device | | |
|---|---|---|---|---|---|
| Valve | support plate | Belt | valve | support plate | belt |
| open | Bottom position | Accelerates | open | Bottom position | Vm |

In stage six of the operation (see FIG. 4*f*), the support plate of the pulling device (2) is raised from the bottom position to receive the next laminar element, while the preceding laminar element is pulled by the suction chamber (2*c*).

| Insertion device | | | Pulling device | | |
|---|---|---|---|---|---|
| Valve | support plate | Belt | valve | support plate | belt |
| open | Bottom position | Accelerates | closed | Top position | Vm |

In stage seven of the operation (see FIG. 4*g*), the front or rear end of the second laminar element is accelerated such that, at this point, it moves very close to the front end of the first laminar element. At the end of this stage, the laminar element (3) has the same speed as the belt of the printing station.

Note that during stages five and seven, the laminar element that is inserted follows a specific acceleration condition (FIG. 5) for the distance between the laminar elements on the belt (6) to be very close.

| Insertion device | | | Pulling device | | |
|---|---|---|---|---|---|
| Valve | support plate | Belt | valve | support plate | belt |
| open | Bottom position | Vm | open | Bottom position | Vm |

Lastly, in stage eight of the operation (see FIG. 4*h*), the laminar element is pulled by the belt of the pulling device (2) and slides on the support plate of the insertion device (1).

| Insertion device | | | Pulling device | | |
|---|---|---|---|---|---|
| Valve | support plate | Belt | valve | support plate | belt |
| closed | Top position | stopped | open | Bottom position | Vm |

The following section describes another mode of operation with sheets of sufficient length.

For sheets (laminar elements) with a length greater than or equal to the distance between the start of the operational suction chamber of the insertion device (1) and the end of the chamber (2*c*) of the pulling device (2), the support plate corresponding to the lifting means (82) could be left permanently in the highest position, and consequently without suction in chambers (2*a*) and (2*b*).

This means that the laminar elements (3) must meet before the support plate of the pulling device (82) finishes and the inserted sheet must be pulled by the belt of the insertion device (71) until it reaches the end of suction chamber 2*c*, at which time the suction force on the belt of the pulling device (72) is sufficient to pull the laminar element (3), such that the support plate of the insertion device (81) can now be raised and the suction operation can be disconnected in suction chambers (1*a*, 1*b*) and the insertion belt (71) can be stopped.

Figure 6A:
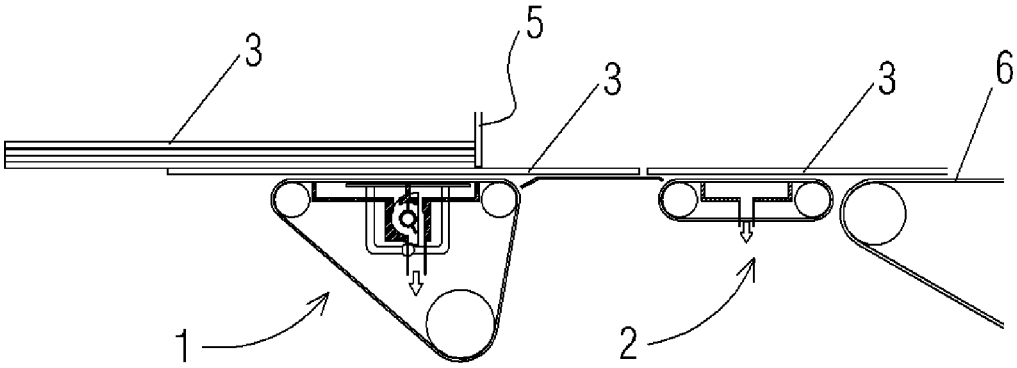
FIGS. 6*a* and 6*b* are schematic views of an alternative embodiment of the insertion assembly with a different pulling device.
Figure 6B:
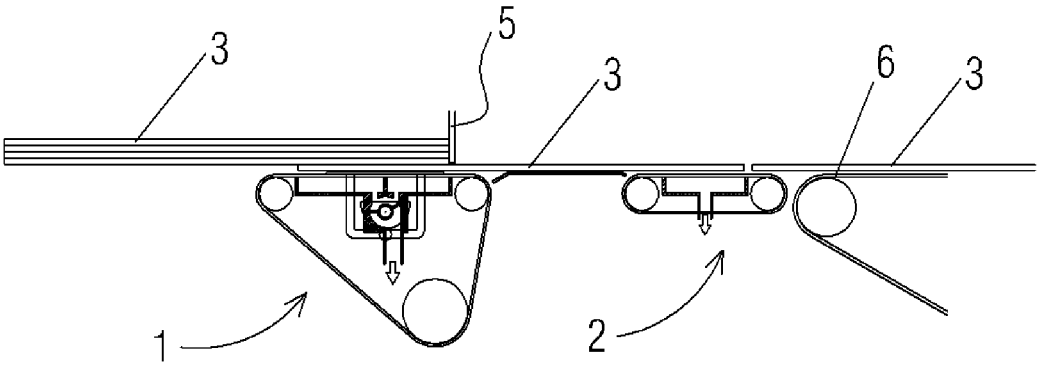

This mode of operation is recommended to reduce energy consumption and wear on the mechanical elements. In another embodiment of the present invention, as shown in FIG. 6, the lifting and suction means of the pulling device could be substituted with a fixed support plate. In the example in FIG. 6, the same numerical references are used to indicate the elements that are the same with respect to the embodiment described above.

The details, shapes, dimensions and other accessory elements used in the manufacture of the device of the invention may be conveniently replaced with others which do not depart from the scope defined by the claims which are included below.

The invention claimed is:

1. An insertion assembly for the continuous and automated feeding of laminar elements into a graphic printing station, with the laminar elements in a stacking area for laminar elements, arranged in at least one column comprising:

an insertion device that includes a rotating belt system on which the laminar elements can be moved horizontally, and suction means, with the insertion device connected to the stacking area, and a pulling device that includes a rotating belt system on which the laminar elements from the insertion device can be moved horizontally, and suction means, with the pulling device connected to a graphic printing station equipped with a rotating belt, with said pulling device adjoining the insertion device in a direction of forward motion, a lifting means that lifts the laminar element with respected to the rotating belt of the insertion device or the rotating belt of the pulling device, with the movement of the lifting means synchronized with the suction means, such that a laminar element is carried from the stacking area to the graphic printing station through the insertion device and the pulling device, with the speed of the rotating belt of the pulling device constant and equal or essentially equal to the speed of movement of a series of movement elements in the printing station, on which the laminar element moves during the operation thereof, wherein the suction means include valve means that are integrally connected to the lifting means, such that when the valve means are open, the lifting means is in a bottom position and when the valve means are closed, the lifting means is in a top position, and being said lifting means connected to an eccentric mechanism and elastic means, with the eccentric mechanism acting on the valve means.

2. The insertion assembly according to claim 1, wherein the insertion device includes a lifting means that lifts the laminar element with respect to the rotating belt of the insertion device, with the movement of the lifting means synchronized with the suction means.

3. The insertion assembly according to claim 1, wherein the pulling device includes a lifting means that lifts the laminar element with respect to the rotating belt of the pulling device, with the movement of the lifting means synchronized with the suction means.

4. The insertion assembly according to claim 1, wherein the suction means housed in the insertion device have two adjoining suction chambers.

5. The insertion assembly according to claim 1, wherein the suction means housed in the pulling device have three adjoining suction chambers.

6. The insertion assembly according to claim 1, wherein the rotating belt system of the insertion device comprises a series of pulleys on which a belt slides, with the pulleys driven by motor means.

7. The insertion assembly according to claim 1, wherein the rotating belt system of the pulling device comprises a series of pulleys on which a belt slides, with the pulleys driven by motor means.

8. The insertion assembly according to claim 1, wherein the lifting means is kinematically connected to an eccentric mechanism and elastic means, with the eccentric mechanism acting on the valve elements.

9. The insertion assembly according to claim 8, wherein the valve elements are integrally connected to the eccentric mechanism.

10. The insertion assembly according to claim 8, wherein the lifting means comprises a support plate with a first horizontal section intended to support a laminar element, and a second section that extends downward and is in contact with the elastic means and the eccentric mechanism.

11. An insertion assembly for the continuous and automated feeding of laminar elements into a graphic printing station, with the laminar elements in a stacking area for laminar elements, arranged in at least one column, comprising:

an insertion device that includes a rotating belt system on which the laminar elements can be moved horizontally, and suction means, with the insertion device connected to the stacking area, and a pulling device that includes a rotating belt system on which the laminar elements from the insertion device can be moved horizontally, and suction means, with the pulling device connected to a graphic printing station equipped with a rotating belt, with said pulling device adjoining the insertion device in a direction of forward motion, such that a laminar element is carried from the stacking area to the graphic printing station through the insertion device and the pulling device, with the speed of the rotating belt of the pulling device constant and equal or essentially equal to the speed of movement of a series of movement elements in the printing station, on which the laminar element moves during the operation thereof, the insertion device including a lifting means that lifts the laminar element with respect to the rotating belt of the insertion device, with the movement of the lifting means synchronized with the suction means, and wherein the suction means include valve elements that are integrally connected to the lifting means, such that when the valve elements are open, the lifting means is in a bottom position and when the valve elements are closed, the lifting means is in a top position.

* * * * *